US005782216A

United States Patent [19]

Haas et al.

[11] Patent Number: 5,782,216

[45] Date of Patent: Jul. 21, 1998

[54] ENGAGEABLE TAPPET FOR A VALVE DRIVE OF AN INTERNAL COMBUSTION ENGINE

[75] Inventors: Michael Haas, Weisendorf; Gerhard Maas, Herzongenaurach; Walter Speil, Ingolstadt; Birger Wollboldt, Rodgau/Hainhausen, all of Germany

[73] Assignee: INA Walzlager Schaeffler KG, Germany

[21] Appl. No.: 817,406

[22] PCT Filed: Aug. 21, 1995

[86] PCT No.: PCT/EP95/03317

§ 371 Date: Apr. 9, 1997

§ 102(e) Date: Apr. 9, 1997

[87] PCT Pub. No.: WO96/12092

PCT Pub. Date: Apr. 25, 1996

[30] Foreign Application Priority Data

Oct. 15, 1994 [DE] Germany ..... 44 36 952.2

[51] Int. Cl.[6] ..... F01L 1/14; F01L 1/24; F01L 13/00

[52] U.S. Cl. ..... 123/90.16; 123/90.5; 123/198 F

[58] Field of Search ..... 123/90.15, 90.16, 123/90.17, 90.48, 90.49, 90.5, 90.55, 198 F

[56] References Cited

U.S. PATENT DOCUMENTS

| | | | |
|---|---|---|---|
| 5,090,364 | 2/1992 | McCarroll et al. | 123/90.16 |
| 5,361,733 | 11/1994 | Spath et al. | 123/90.16 |
| 5,402,756 | 4/1995 | Bohme et al. | 123/90.16 |
| 5,431,133 | 7/1995 | Spath et al. | 123/90.16 |
| 5,555,861 | 9/1996 | Mayr et al. | 123/90.16 |

FOREIGN PATENT DOCUMENTS

| | | |
|---|---|---|
| 4206166 | 9/1992 | Germany . |
| 93 06 685.6 U1 | 7/1993 | Germany . |
| 9306685 U | 7/1993 | Germany . |
| 93 15 436.4 U1 | 2/1994 | Germany . |
| 94 03 420.6 U1 | 6/1994 | Germany . |
| 94 03 422.2 U1 | 6/1994 | Germany . |
| 4094405 | 3/1992 | Japan . |
| 94-21899 | 9/1994 | WIPO . |

*Primary Examiner*—Weilun Lo
*Attorney, Agent, or Firm*—Bierman, Muserlian & Lucas

[57] ABSTRACT

A tappet (1) is to be engageable on to at least three different cam profiles with an optional zero lift. To this end the tappet (1) consists of an annular base section (2) enclosing a circular base section (3). Both base sections (2, 3) can be coupled together via radially adjustable coupling devices (10). An additional, axially movable inner piston (18) is fitted in a guide sleeve (7) of the circular base section (3). The inner piston (18) can be decoupled via further coupling means (23) so that the tappet (1) can be completely decoupled from the guide sleeve (7).

44 Claims, 8 Drawing Sheets

Fig. 6 (VI-VI)

Fig. 7 (VII-VII)

ENGAGEABLE TAPPET FOR A VALVE DRIVE OF AN INTERNAL COMBUSTION ENGINE

The invention concerns a tappet for a valve drive of an internal combustion engine comprising an annular bottom portion arranged concentrically around a circular bottom portion, the annular bottom portion being loaded in stroke direction by at least one cam of higher lift than the circular bottom portion, and said annular and circular bottom portions being slidable relative to each other, the tappet being guided for longitudinal displacement in a bore of a cylinder head by a skirt connected to the annular bottom portion, while a cam-distal end surface of the circular bottom portion receives a guide bush which is at least partly and indirectly surrounded by a bore of the annular bottom portion, at least one radially displaceable first piston which serves as a coupling element for a selective positive coupling between the two bottom portions in a base circle phase of the cams being arranged in a region within or near the two bottom portions, and said first piston can be loaded in at least one direction of travel by a hydraulic medium and in an opposite direction of travel optionally by hydraulic medium or by a force of at least one spring, while, to establish a coupled state, said first piston overlaps a separating surface extending in axial direction between said two bottom portions.

STATE OF THE ART

In a tappet of the aforesaid type known from DE-A 42 06 166, a coupling between the two bottom portions is achieved by pistons which are displaceable radially inwards by a hydraulic medium. In this coupled state, the outer high lift cam acts on the tappet. This tappet is a compromise as far as its lifting curve is concerned. It enables either a maximum lift through the outer high lift cams or a low lift through the central cam. Thus it is possible to set a suitable valve lift curve for high and low engine speeds because, generally speaking, large valve cross-sections are only desirable at high engine speeds. On the other hand, it is desirable in multi-valve engines, to shut down a valve or complete rows of cylnders, for example in V-engines, so that the engine can be operated with notably reduced throttling losses at low load. However, this generic prior art document contains no suggestions as to a configuration of a valve drive tappet which would make it switchable between different valve lift curves, or between a zero lift curve and two different lift curves, and at the same time permit a complete valve shut-down with the help of the switching mechanism.

OBJECTS OF THE INVENTION

It is therefore an object of the invention to improve a tappet of the generic type to eliminate the aforesaid drawbacks and provide a compact switching mechanism which enables coupling for three different valve lifts one of which permits the gas exchange valve concerned to remain completely closed.

DESCRIPTION OF THE INVENTION

The invention achieves this object by the fact that an inner piston is slidably arranged in a bore of the guide bush at a distance from the cam-distal end surface of the circular bottom portion, the opposite end surface of the inner piston cooperating at least indirectly with an end of a valve stem, and the inner piston comprises at least one radial bore for lodging a second piston which constitutes a coupling element which is displaceable in the base circle phase of the cams optionally by hydraulic medium or by the force of a spring. These measures of the invention permit the valve lift to be adapted to different engine speeds so that an optimum filling of the cylinder with the fuel-air mixture can be achieved. On the other hand, it is possible for the first time to simultaneously realize a third coupling or switching step which can be designed for a zero lift, if desired, so that, as described above, complete rows of cylinders can be shut-off while other cylinder rows are in operation. These measures are particularly advantageous in engines having six or more cylinders but can equally well be used in internal combustion engines with less cylinders.

With a suitable contour of the low lift cam, a small residual valve lift can be retained in place of the zero lift. Such a design allows more freedom in the layout of the gas exchange process.

The subject matter of the invention can be used not only in the cup-shaped tappets illustrated herein but is also conceived for use in lever-type drives. An important advantage of the invention is that only two control cams are required per valve for obtaining three different lifts, and additional oil pumps can be dispensed with. Depending on the particular case of use, a coupling of the elements can also be achieved by other means such as electric, magnetic, pneumatic, electromagnetic, different mechanical means and the like. It is also conceivable, in contrast to the embodiments described hereinafter, to accomplish a coupling of the bottom portions with servo assistance such as by hydraulic medium, and an uncoupling by mechanical means, or alternatively, an uncoupling for the individual coupling steps by hydraulic medium and a coupling by mechanical or similar means. An additional advantage of the invention is that no complicated modifications to existing cylinder heads are required. A larger number of lifting steps is conceivable in which, with n control cams, n+1 valve lifts can be realized.

The advantages of a selective shutting-off of cylinders and the variation of valve lifts will not be discussed here further because these are well-known in the art.

Thus, the bore for the second piston arranged in the inner piston is made as a through-bore in whose ends the second pistons are arranged diametrically opposite each other, the second pistons can be displaced radially outwards by the force of at least one compression spring, so that, in the absence of effective hydraulic pressure, said second pistons overlap the annular gap between the two elements and extend partly into a bore of the guide bush, and that the second pistons can be pushed by hydraulic pressure, against spring force, into their bore in the inner piston so that their outer end surfaces do not project radially outwards beyond the opening of the bore. This claim as well as the following sub-claims concern the switching steps which are generally practicable with the tappet of the invention described herein. If, now, the hydraulic pressure is so low, that the first pistons remain in the circular bottom portion, while the second pistons extend into the guide bush, a partial lift of the tappet is achieved by simple means. With an increase of hydraulic pressure, the second pistons can be displaced completely into their bore in the inner piston, and this leads to a zero lift of the tappet. By increasing the oil pressure further and assuring that the second pistons extend in their reception in the guide bush in this state of coupling, the first pistons can be displaced into their radial bore in the annular bottom portion. In this way, the tappet is coupled so that the high lift cam is effective.

A simple way of making the reception for the second piston for its coupled state, is to provide a further bush within the guide bush for directly receiving the inner piston. This further bush then comprises the bore for the second piston. This construction is equally feasible for all the other embodiments of the tappet described herein.

According to another feature of the invention, a transverse bore extends through the guiding part and through a collar of the annular bottom portion so that a simple means of oil supply to the second pistons for their radially inward movement in uncoupling direction is obtained. Although in the present case provision is made for a separate supply of hydraulic medium to the first and the second pistons through separate oil inlets, not specified here, arranged in the skirt of the tappet, it is equally possible to have a common oil inlet in the skirt.

In a further advantageous embodiment of the invention, the bore for the second piston in the inner piston is made as a pocket bore, on whose base the second piston is supported by a compression spring, said second piston in its idling position overlaps the annular gap between the inner piston and the guide bush and extends partially, at least indirectly, in a radial bore of the guide bush, a further radial bore sealed radially outwardly in an oiltight manner by a bushing or a disc is arranged in the annular bottom portion and, in the base circle phase of the cams, is aligned to the bore for the second piston, the second piston can be pushed inwards against the force of the compression spring by hydraulic medium which can be transferred into the radial bore of the annular bottom portion up to a point directly in front of an outer end surface of the second piston, so that the second piston no longer protrudes radially outwards from its bore in the inner piston. There are concern the different states of coupling obtainable with the tappet. With a low hydraulic pressure, the force of the compression spring which acts on the second piston causes it to extend into the the radial bore of the guide bush, while the first piston remains in its bore in the annular bottom portion. Thus, a partial lift of the valve cooperating with the tappet is achieved in this state of coupling by simple means. If, now, hydraulic medium is conducted through a separate duct to a point in front of the outer end face of the second piston, this latter is displaced inwards, whereby the gas exchange valve concerned is shut off. If the first-mentioned coupling state is established for the second piston, and the first piston is loaded by hydraulic medium so as to be pushed into its radial bore in the guide bush, a state of positive engagement is established between the outer annular bottom portion, the guide bush and the inner piston as a result of which the gas exchange valve executes a maximum lift. It is also conceivable to omit the compression and tension springs and establish all the states of coupling by hydraulic means. An alternative embodiment of the invention is wherein the first and the second pistons are telescopically slidable in each other. To understand this embodiment, it is important to know that both pistons are urged radially outwards by compression springs and that the force of the compression spring acting on the first piston is smaller than the force of the compression spring of the second piston. In the absence of effective hydraulic pressure, the first piston overlaps the separating surface between the outer annular bottom portion and the guide bush, while, at the same time, the second piston overlaps the annular gap between the guide bush and the inner piston. In this state, a maximum lift of the tappet is effective. With increasing hydraulic pressure, the first piston is pushed into a recess of complementary shape in the second piston, which has a bush-like configuration, till its outer end surface no longer overlaps the separating surface. The tappet now follows the contour of the low lift central cam. With a further increase of hydraulic pressure, the complete unit consisting of the first and the second piston is displaced further inwards in radial direction till it no longer overlaps the annular gap. The tappet now executes an idle stroke relative to the inner piston and the gas exchange valve concerned remains closed. It is also possible to pressurize this telescopic arrangement radially from the inside to the outside by hydraulic medium, or to use a modified combination of compression springs and hydraulic medium.

A simple means of preventing relative rotation between the inner piston and the guide bush, and between the annular bottom portion and the guide bush, is to provide flattened portions on a ring inserted into the bore of the guide bush and on a securing element extending radially from the annular bottom portion.

A further embodiment of a tappet can be switched off or coupled to different valve lift curves. The bore for the second piston extends generally at right angles to and in a common transverse plane with the bore for the first piston, and, in the absence of effective hydraulic pressure, the first piston can be displaced radially inwards by the force of at least one compression spring so as to overlap the separating surface between the annular bottom portion and the circular bottom portion. A special feature of this embodiment is that by the provision of a central oil supply and separate intermediate discs, a displacement of the first and the second piston is accomplished radially from the inside to the outside for establishing the different coupling steps. In the presence of a low hydraulic pressure, the second piston remains in its reception space in the inner piston. An intermediate disc and a push-out element are disposed radially inwards of the first piston. The arrangement of these three elements is such that, in the absence of effective hydraulic pressure, a force transmission takes place from the high lift cam through the annular bottom portion, the guide bush and the inner piston to the gas exchange valve. At the same time, the force of a tension spring which fixes the second piston radially inwardly is greater than the force of a compression spring which displaces the first piston arrangement radially inwards.

With increasing hydraulic pressure, the first piston arrangement is displaced radially outwards till the intermediate disc having a thickness corresponding to that of the guide bush extends entirely in its bore in the guide bush. In this state, a zero lift of the gas exchange valve is realized. On a further increase of hydraulic pressure, the second piston is displaced against the force of the tension spring into its recess in the guide bush. This state effects a partial lift of the valve.

To limit the radial displacement of the push-out element and the elements arranged in front of it, the push-out element advantageously comprises a groove into which a stop element engages. The length of the groove corresponds to the desired displacement of the push-out element. In this way, a further radial excursion of the first piston arrangement is prevented for the coupled state of partial lift with the second piston engaging into its recess.

A simple support surface for the compression spring which loads the first piston radially inwards is created by a bushing arranged in the radial bore of the annular bottom portion for the first piston. This bushing comprises a bore through which the air displaced by the displacement of the first piston can escape.

A prevention of relative rotation between the tappet components is again achieved by cooperating flattened portions.

A further advantageous embodiment of the invention is the spring for the second piston arranged in the bore provided for the second piston in the inner piston is configured as at least one tension spring. An intermediate disc arranged in front of the second piston and urged radially inwards by a compression spring which is fixed at one end in a radial bore of the guide bush overlaps the annular gap between the inner piston and the guide bush in the absence of effective hydraulic pressure. In the base circle phase of the cams, this radial bore of the guide bush is aligned to the bore for the second piston in the inner piston. The first piston is arranged circumferentially offset in its bore in the annular bottom portion and is displaceable radially inwards by the force of at least one compression spring. In the absence of effective hydraulic pressure, the inner end surface of the first piston does not intersect the separating surface between the two elements, so that a partial lift of the tappet is realized. Thus, this claim concerns the "initial position" of the tappet components at only a slight effective hydraulic pressure. The further claims concern alternative coupling steps. The first coupling step with only slight hydraulic pressure therefore corresponds to a partial lift of the tappet because the intermediate disc establishes a positive engagement between the guide bush and the inner piston. With increasing hydraulic pressure, the second piston is displaced radially outwards till it is positioned in front of the annular gap. This state corresponds to an idle stroke of the tappet as a whole. In a particularly advantageous manner, the second and the first piston are supplied with hydraulic medium from the cylinder head through a single common duct.

On a further increase of hydraulic pressure, the inner piston rotates together with the second piston relative to the additional intermediate piston till the radial bores for the second and the first piston are aligned to each other. On a still further increase of hydraulic pressure, the first piston is displaced radially outwards by the second piston so that the separating surface and the annular gap are simultaneously overlapped by piston elements. Thus, in this state of coupling, a maximum lift of the tappet is realized by simple means.

Stop surfaces for the rotatable inner piston are created and defined by the radially extending wing of the intermediate piston.

To create a simple means for resetting the inner piston relative to the wing of the intermediate piston, the inner piston is urged by a torsion spring in a rotating direction opposite to the rotating direction produced by the hydraulic pressure. However, it is also conceivable to effect resetting by hydraulic pressure or other similar, suitable means.

A simple support for the compression spring which loads the first piston in radially inward direction is created by fixing the radially outer end of this spring to a bottom of a bushing arranged in the bore for the first piston. However, this can also be achieved by a disc, a securing ring or a similar suitable element. Advantageously, the bushing or disc comprises an opening to permit an escape of the compressed air during the displacement of the first piston.

In an alternative embodiment of the invention, at least one further annular bottom portion is arranged in the bore of the annular bottom portion radially between this bore and an outer peripheral surface of the guide bush. This further annular bottom portion is contacted by at least one cam having a smaller or a different lift than the cam acting on the annular bottom portion arranged therearound, which further annular bottom portion can be selectively coupled to at least one of the other bottom portions by the radially displaceable first pistons. With such an arrangement, it would be possible to realize any desired number of different valve lifts. The number of cams of different diameters would correspond to the number of different lifts desired. The central cam effects a zero or a minimum lift. The claims which follow, again concern the various coupling steps. In a pressureless state, a maximum lift is obtained due to the positive engagement between the bottom portions. With increasing hydraulic pressure, the first piston is displaced completely into its radial bore, so that a partial lift corresponding to the smaller lift of the radially inwardly adjacent cam is effected. With a further increase of hydraulic pressure, the sliding element which till then loaded the first piston is displaced partially into the radial bore of the first piston till the inner end surface of the sliding element extends in front of the outer peripheral surface of the circular bottom portion. The tappet now follows the contour of the central cam. If, in this embodiment, the cams of different sizes are differently associated, different lifts are obtained in the respective coupling steps.

A simple limitation of the displacement path of the entire piston assembly is obtained by a pin-and-groove connection on the central push-out element. However, it is also conceivable to create a positive stop for limiting the radial displacement of the piston assembly by recesses extending from the bottom portion concerned towards the piston assembly, or by a reverse arrangement thereof.

To create an internal flow of forces for a compression spring which is supported by a sheet metal ring on one end of the guide bush, the circular bottom portion and the further annular portion surrounding it comprise a radially outwards projecting collar which may likewise be provided in the other embodiments of the present invention as well. These collars also serve as axial stops for bore-proximal steps of the outer and the further annular portions. Thus it is guaranteed that the radial bores for the pistons are situated in the same transverse plane of the tappet in the base circle phase of the cams, and the cam follower as a whole cannot fall apart during transport. Thus, costenhancing, additional transport security devices can be dispensed with.

It is possible in this, and all the other embodiments of the invention to arrange the pistons within surrounding bushings. Particularly the first, radially outer piston can be supported by its compression spring on the bottom of such a bushing but it is also possible to replace the bushing for the first piston by a disc acting as a stop element.

It is particularly advantageous, for all the switchable tappets to provide a hydraulic clearance compensation element at a cam-distal end of the tappets in the bore of the guide bush. Oil supply to this clearance compensation element and the pistons can be effected through a common supply duct starting from the skirt of the tappet. An otherwise required adjustment of valve clearance thus becomes superfluous in all the tappet embodiments.

It is likewise possible to provide a deaeration bore in the circular bottom portion. This is required as a simple means to enable an escape of air which is compressed in the guide bush during the relative idle stroke travel of the inner piston. If no such provision is made, the idle stroke travel of the inner piston could be unnecessarily rendered more difficult by the growing air cushion. At the same time, an excess of hydraulic medium can be evacuated through this deaeration bore.

Different hydraulic pressures are required for the different coupling steps but the invention is also implementable with other hydraulic pressures. As already mentioned, the invention provides for the elimination of additional oil pumps. A coupling of the elements can be effected in an unpressurized state or under pressure. It is likewise possible to separate the hydraulic element from the different hydraulic oil supply pressures of the coupling elements and provide separate supply ducts for the hydraulic element and the coupling elements. This has the additional advantage that any vibrations transmitted from the coupling elements to the oil column are physically uncoupled from the hydraulic element. Tests have shown that under extremely unfavorable conditions, the vibrations of the oil column can lead to an undesired opening of the hydraulic element in its high pressure phase.

The idle stroke travel of the circular bottom portion relative to the inner piston is defined by the distance allowed from the cam-proximal end surface of the inner piston to the guide bush. In this way, it is assured that no undesired opening of the gas exchange valve takes place during a desired zero lift.

Finally, it is conceivable to make at least one of the components (bottom portions, guide bush, hydraulic piston . . . ) of a plastic or a light-weight material. If necessary, wear-resistant layers can be additionally provided on wear surfaces such as the contact surfaces between the bottom portions and the control cams. It is also conceivabe to implement wear protection measures in the edge regions of the radial bores for the first and the second pistons and the push-out element. Using light-weight material advantageously reduces the oscillating masses in the valve drive.

The invention is not limited to the features recited in the claims. Rather, combinations of individual features of the claims and, in particular, combinations of the sub-claims concerning the different coupling steps for each embodiment are both conceivable and intended as are also combinations of individual claimed features with the disclosures made in the discussion of advantages and in the description of the embodiments of the invention.

Figure 1:
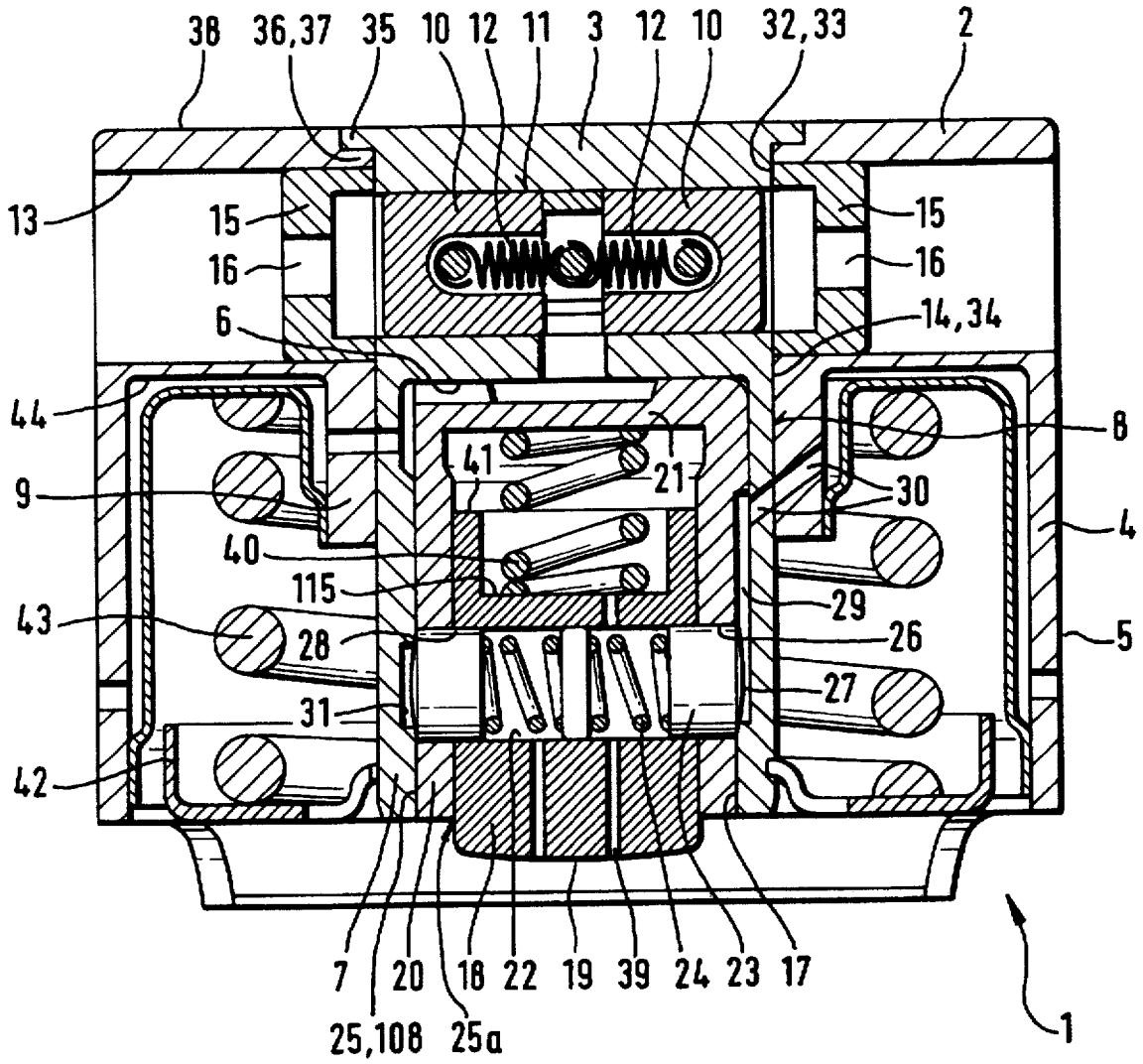
FIG. 1 is a longitudinal cross-section through a first embodiment of a tappet of the invention.

The description of FIG. 1 which now follows will explain not only the particular embodiment concerned but the switchable tappet of the invention in general.

FIG. 1 shows a tappet 1 comprising an annular bottom portion 2 which encloses a circular bottom portion 3. The annular portion 2 is contacted by at least one cam of higher lift than the circular bottom portion 3. A hollow cylindrical skirt 4 is integrally connected to the annular bottom portion 2. An outer peripheral surface 5 of the skirt 4 of the tappet 1 extends in a bore of a cylinder head, not shown. On its cam-distal end surface 6, the circular bottom portion 3 comprises a guide bush 7 which is surrounded by a bore 8 of the annular bottom portion 2 or by a collar 9 thereof. Two radially outwards displaceable first pistons 10 extend within the two bottom portions 2, 3. The figure shows these pistons 10 in their idling state in a radial bore 11 of the circular bottom portion 3. Each of these portions is held in its radial bore 11 by the force of a tension spring 12 acting radially inwards. In the base circle phase of the cams, not represented here, a further radial bore 13, made here as a through-bore, is aligned to the radial bore 11. When a coupling is desired, each of the first pistons 10 can be displaced by hydraulic medium into the radial bore 13, and a positive engagement is established between the two bottom portions 2, 3. This coupling mechanism will not be described here in more detail nor in the description of the rest of the figures because it has already been discussed in the introductory part of the present application and is well-known in the art.

To limit the radially outward directed movement of the first pistons 10, each of the radial bores 13 of the annular bottom portion 2 comprises a stop bush 15. To enable a free escape of leaking hydraulic medium and compressed air these stop bushes 15 comprise an opening 16. However, it is also conceivable to use other stop elements 15 such as, for instance, discs, securing rings, stop lugs and the like.

To implement the third coupling step, an axially displaceable inner piston 18 is arranged in a bore 17 of the guide bush 7 at a distance from the cam-distal end surface 6 of the circular bottom portion 3. One end 19 of this inner piston 18 faces an end of a valve stem, not represented, of a gas exchange valve. The guide bush 7 in this case is made in two parts, so that the inner piston 18 extends directly in a further bush 20 which is fixed in the guide bush 7 and whose bottom 21 bears against the circular bottom portion 3. A further radial bore 22 lodging a second piston 23 at each end is arranged in the inner piston 18. These pistons 23 are loaded radially outwards by the force of one compression spring 24 each. In the embodiment shown here, the second pistons 23 overlap an annular gap 25 between the elements 20, 18 and thus extend partially in a bore 26 of the guide bush 7, or of its bush 20.

To effect the initially described zero lift, the second pistons 23 are displaceable radially inwards by hydraulic medium against the force of their compression springs 24. In this coupled position, their outer end surfaces 27 no longer extend beyond the opening 28 of the bore 22.

A supply of hydraulic medium to a point in front of the outer end surface 27 of the second pistons 23 is effected in that a channel 29 extends axially in the further bush 20 to a point in front of the end surface 27 of the second pistons 23. This channel 29 opens in cam direction into a transverse bore 30 made through the collar 9 and the guide bush 7. Advantageously, an annular space 31 for the hydraulic medium is arranged directly in front of the outer end surface 27 of the pistons 23. A relative rotation of the two bottom portions 2, 3 is prevented by radially inner end surfaces 32 of the stop bushes 15. These cooperate with flattened portions 33 (see also the following figures) on the outer peripheral surface 34 of the guide bush 7.

To limit the axial displacement of the two bottom portions 2, 3 relative to each other and to prevent them from coming apart, the circular bottom portion 3 comprises a radially protruding collar 35 on its cam-proximal end. When the elements 2, 3 are in the pushed-together state, the collar 35 cooperates with a radially inwards oriented portion 36 (step 37).

In this embodiment, separate hydraulic medium paths are provided for the loading of the first and the second pistons 10, 23, but these will not be discussed further at this point of the description. To effect a simple removal of the air enclosed in the inner piston 18, this latter comprises at least one axially extending deaeration bore 39. The inner piston 18 is at the same time supported against the cam-distal end surface 6 of the circular bottom portion 3 by a compression spring 40. A cam-proximal end surface 41 of the inner piston 18 is spaced from the cam-distal end surface 6 of the circular bottom portion 3 or from the bottom 21 of the bush 20 by a distance which corresponds at least to a height of a desired zero lift travel of the inner piston 18 relative to the guide bush 7.

A cam-distal end of the guide bush 7 is surrounded by a sheet metal ring 42 on which one end of a compression spring 43 is supported whose other end acts directly on a cam-distal end 44 of the annular bottom portion 2.

In the configuration shown in this figure, only the inner piston 18 and the bush 20 are coupled to each other. In this state, the tappet 1 executes a small stroke corresponding to the central cam acting on the circular bottom portion 3. If hydraulic medium is now transferred through the bores 30, 29 and 31 to a point in front of the end surfaces 27 of the second pistons 23, these pistons are displaced radially inwards and remain in their radial bore 22 in the inner piston 18. In this way, a zero lift of the gas exchange valve concerned is obtained by simple means. If, however, the initially described coupled state of the second pistons 23 is retained, and the first pistons 10 are displaced by hydraulic medium radially outwards into the radial bore 13 up to the stop disc 15, a positive engagement is established between the two bottom portions 2, 3. The tappet 1 now follows the contour of the outer high lift cam which loads the annular bottom portion 2 in stroke direction.

Since the embodiment of FIG. 1 is not provided with a clearance compensation element, the valve play can be adjusted with the help of shims disposed between the valve and the inner piston 18. However, it is also conceivable to configure the cam contacting surface of the circular bottom portion 3 so that a valve play adjusting shim can be inserted.

Figure 2:
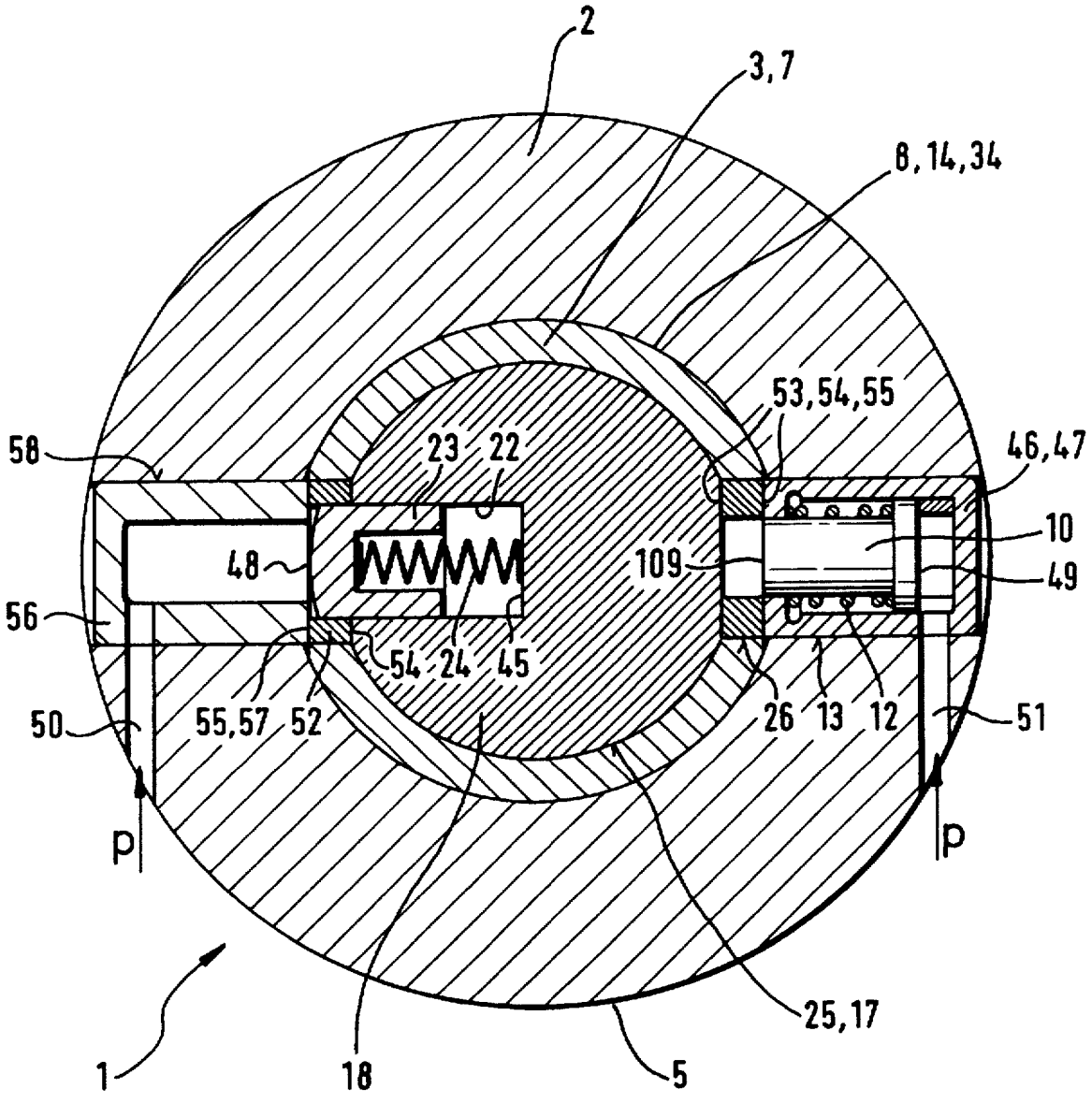
FIG. 2 is a cross-section through a switching device of the invention.

FIG. 2 shows a first alternative embodiment of the invention in a cross-sectional view. In this embodiment, the bore 22 for the second piston 23 is made as a pocket bore. A spring 24, here a compression spring, supported on the base 45 of the bore 22 urges the second piston 23 radially outwards. The further radial bore 13 for the first piston 10 extends in the annular bottom portion 2. In the base circle phase of the cams, the bores described here are aligned to each other. A bushing 46 is fitted into the bore 13 with its bottom 47 oriented radially outwards. The first piston 10 is retained in a radially outer position by the force of the spring 12, here a compression spring.

This configuration corresponds to a partial stroke of the tappet 1 which is realized in the manner described in the statement of advantages in connection with the claims. Hydraulic medium can be routed to end surfaces 48, 49 of the pistons 23, 10 through bores 50, 51 extending in chord-like manner through the annular bottom portion 2. A prevention of relative rotation between the elements 2, 3, 18 is again achieved by a ring 52 extending in each radial bore 26 of the guide bush 7. Both end surfaces 53 of the ring 52 cooperate with corresponding opposing flattened portions 54, 55 on the inner piston 18 and on the bushing 46 or on a bushing 56 of the annular bottom portion 2. The bushing 56 in the annular bottom portion 2 serves only for a supply of oil for a radially inward displacement of the second piston 23. The end surface 57 of the bushing 56 likewise cooperates with the flattened portion 55 of the ring 52.

Figure 3:
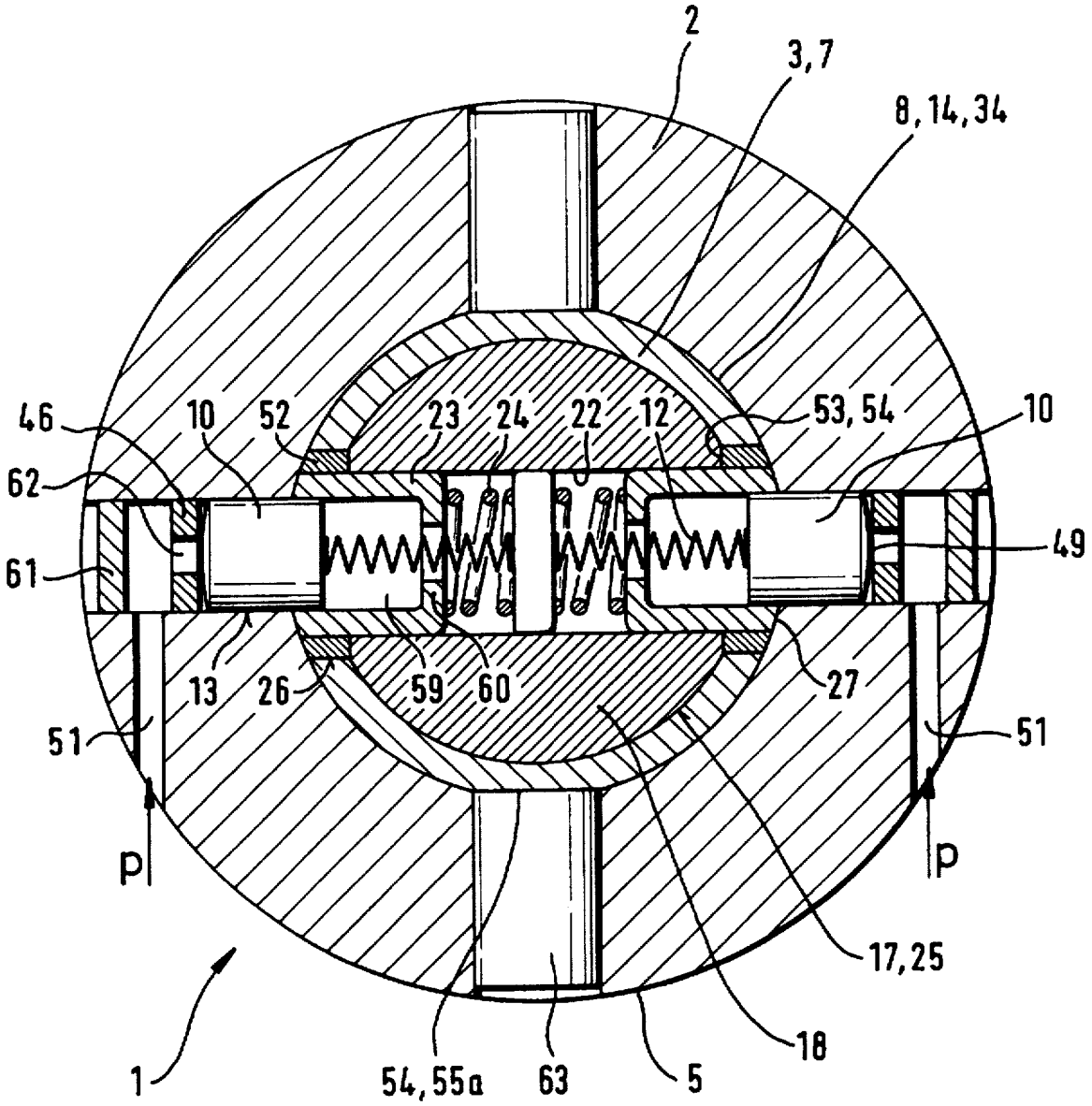
FIG. 3 is a cross-sectional view of a further embodiment of a three-fold switchable tappet.

FIG. 3 is a cross-sectional view of a further arrangement of the coupling elements. A special feature of this embodiment is that the two pistons 10, 23 are telescopically slidable into each other. Each tappet 1 comprises two piston arrangements 10, 23 situated diametrically opposite each other in a common transverse plane.

The first piston 10 again extends in the radial bore 13 of the annular bottom portion 2 and, in the absence of effective hydraulic pressure, overlaps the separating surface 14 between the elements 2 and 7. The second piston 23 in this case has a bush-like configuration with its opening 59 pointing radially outwards. The second piston 23 is urged radially outwards by the force of its inner compression spring 24. In this coupling state, the second piston 23 does not intersect the separating surface 14 but the annular gap 25 between the elements 7 and 18. Due to the fact that the first piston 10 overlaps the separating surface 14 while extending at the same time in the inner cavity 59 of the second piston 23, the coupling state shown in the figure corresponds to a maximum stroke of the tappet 1. If hydraulic medium is now routed through the bore 51 to outer end surface 49 of the first piston 10, this is displaced against the force of the compression spring 12 towards a bottom 60 of the second piston 23. When the piston 10 extends entirely within the second piston 23, it no longer protrudes radially outwards with its outer end surface 49 beyond the separating surface 14 so that a partial stroke of the tappet 1 as a whole is realized. On a further loading by hydraulic pressure the complete assembly 10, 23 is displaced radially inwards beyond the annular gap 25. This coupling state corresponds to the desired zero lift of the tappet 1. An important factor for the functioning of this device is that the compression spring 12 is designed to be weaker than the compression spring 24.

A supply of hydraulic medium into the bore 13 of the annular bottom portion 2 is effected again through bores 51 extending in chord-like manner through the annular bottom portion 2. The radial bore 13 is sealed in an oiltight manner at its outer end by a plug 61. The hydraulic medium is delivered from the chordlike bore 51 through its outlet situated between the plug 61 and the disc 46. The disc 46 comprises an aperture 62 for a free transfer of hydraulic medium to the end surface 49 of the first piston 10. The disc 46 serves at the same time as an axial stop for the first piston 10.

A prevention of rotation of the guide bush 7 relative to the inner piston 18 is achieved by the same means as in the embodiment of the previous figure. A prevention of relative rotation between the annular bottom portion 2 and the guide bush 7 (circular bottom portion 3) is achieved in this case a by securing element 63 which extends in the annular bottom portion 2 and is arranged circumferentially offset to the bores 13, 22 for the pistons 10, 23. At its radially inner end, the securing element 63 comprises a flattened portion 54 which cooperates with a corresponding flattened portion 55*a* on the outer peripheral surface 34 of the guide bush 7.

Figure 4:
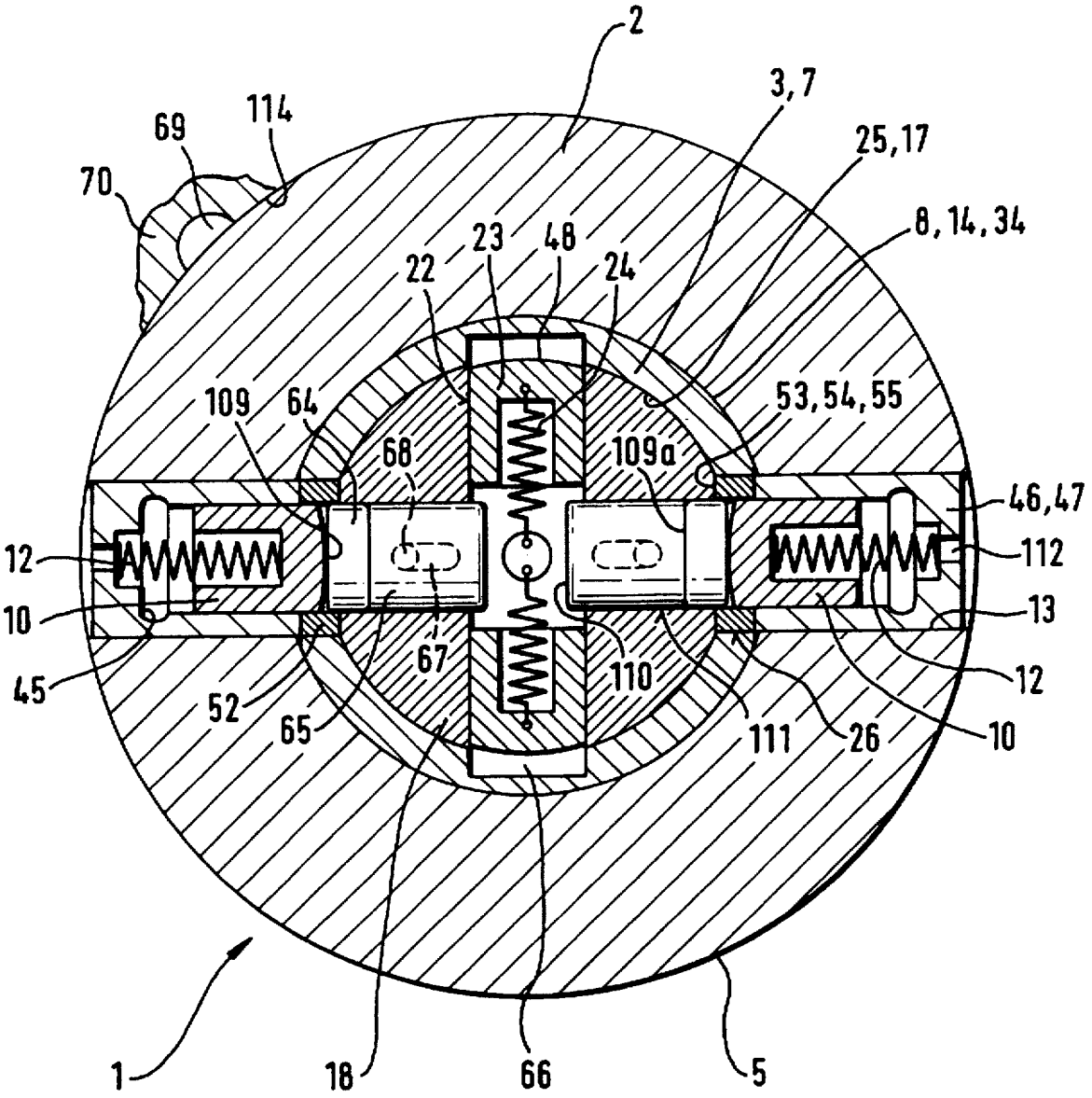
FIG. 4 shows an alternative embodiment to that of FIG. 3, FIGS. 5–7 show a further embodiment of a three-fold switchable tappet.

FIG. 4 shows a further alternative embodiment corresponding to the previous one but with the axis of the first piston 10 extending at right angles to the axis of the second piston 23. A person of the art will discern one pair each of opposing pistons 10, 23 in FIG. 4. An intermediate disc 64 is arranged radially inwards of the first piston 10 and can be loaded in radially outward direction by a push-out element 65 arranged radially inwards thereof. The first piston 10 is urged radially inwards, again by the force of a compression spring 12.

FIG. 4 shows the coupling state in the absence of effective hydraulic pressure. Since the piston 23 is retained by its tension spring 24 entirely in its bore 22, and the other elements 10, 64 overlap both the separating surface 14 and the annular gap 25, a maximum stroke of the tappet 1 is realized. The force of the tension spring 24 is designed to be stronger than the force of the compression spring 12. Thus, with increasing hydraulic pressure, the assembly 10, 64, 65 is displaced radially outwards till the element 64 comes to be positioned completely within the ring 52. Since the thickness of the intermediate disc 64 corresponds to the thickness of the ring, an idle stroke of the complete assembly is realized.

As for the rest, it is possible to increase the hydraulic pressure further so that the peripheral surface of the piston 23 is partially displaced into a mating recess 66. In this state, a partial stroke of the tappet 1 as a whole is realized. To limit its radial displacement, the push-out element 65 comprises a longitudinal groove 67 into which a stop element 68 engages.

A prevention of rotation of the annular bottom portion 2 with its skirt 5 (see FIG. 1) relative to its bore 114 in the cylinder head 70 is implemented by at least one longitudinally extending cylindrical body 69 in the skirt 5. Alternatively, this body 69 may extend from the bore 114 of the cylinder head 70 and engage into a longitudinal groove of the skirt 5.

Figure 5:
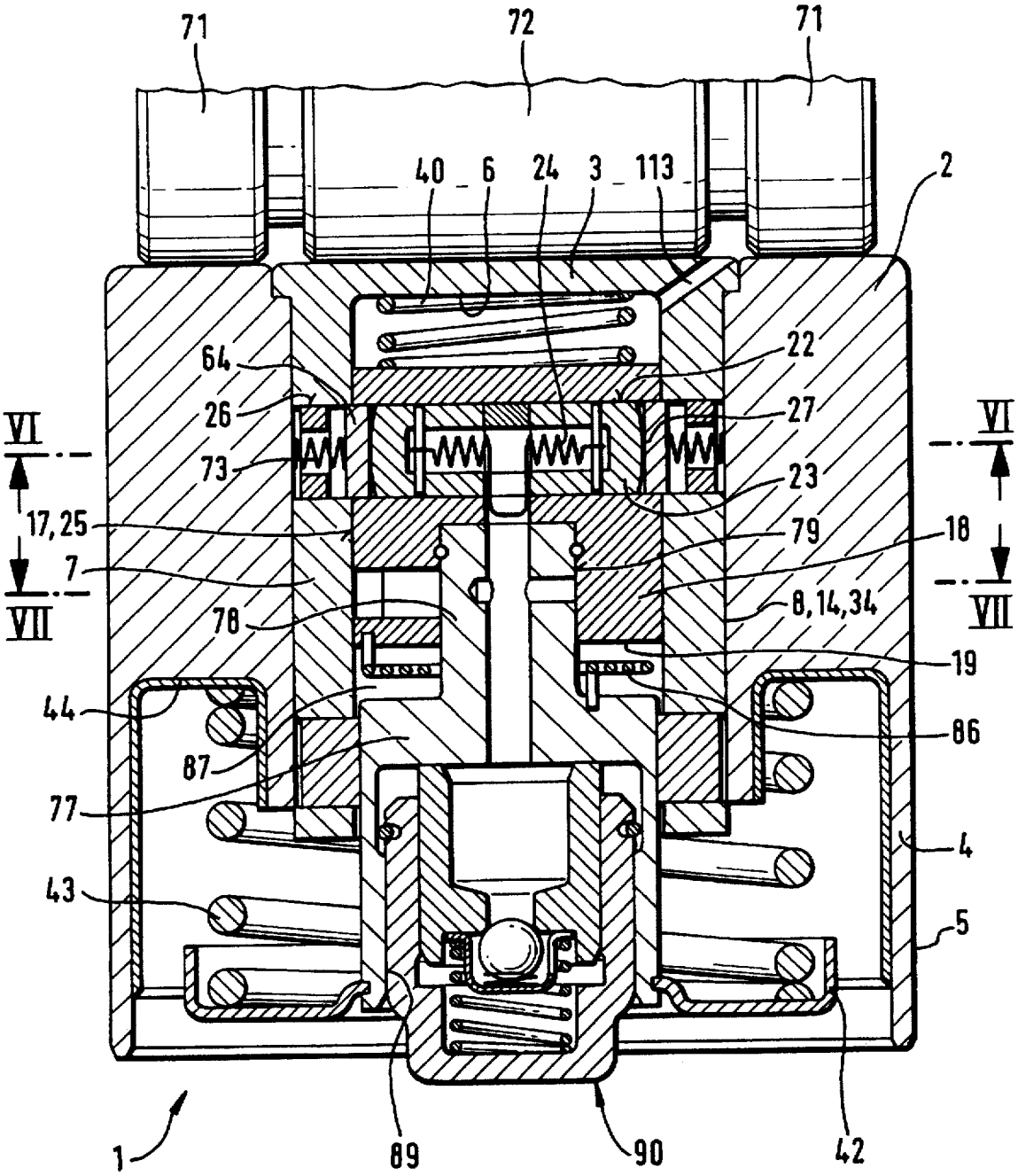
Figure 6:
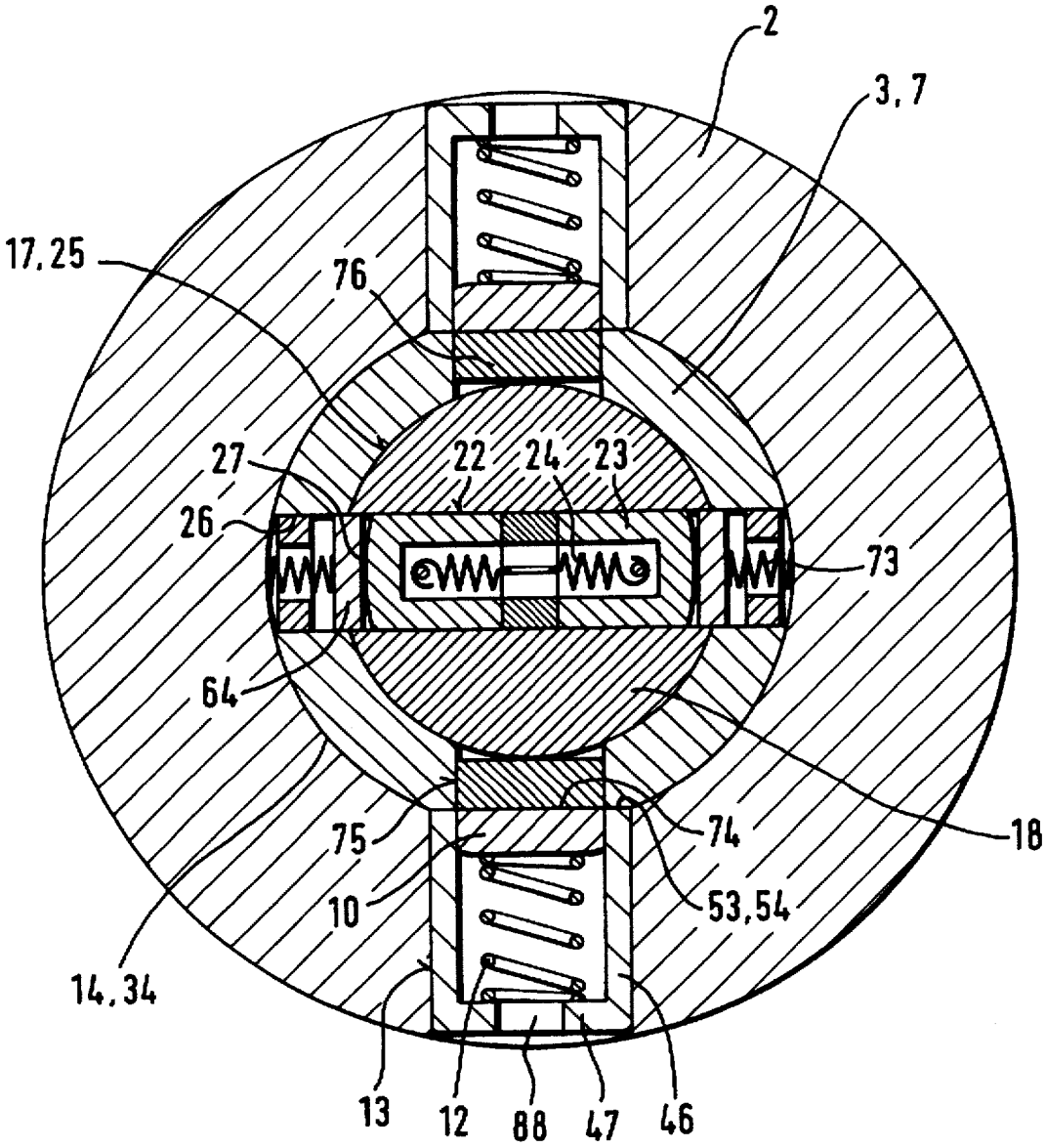
Figure 7:
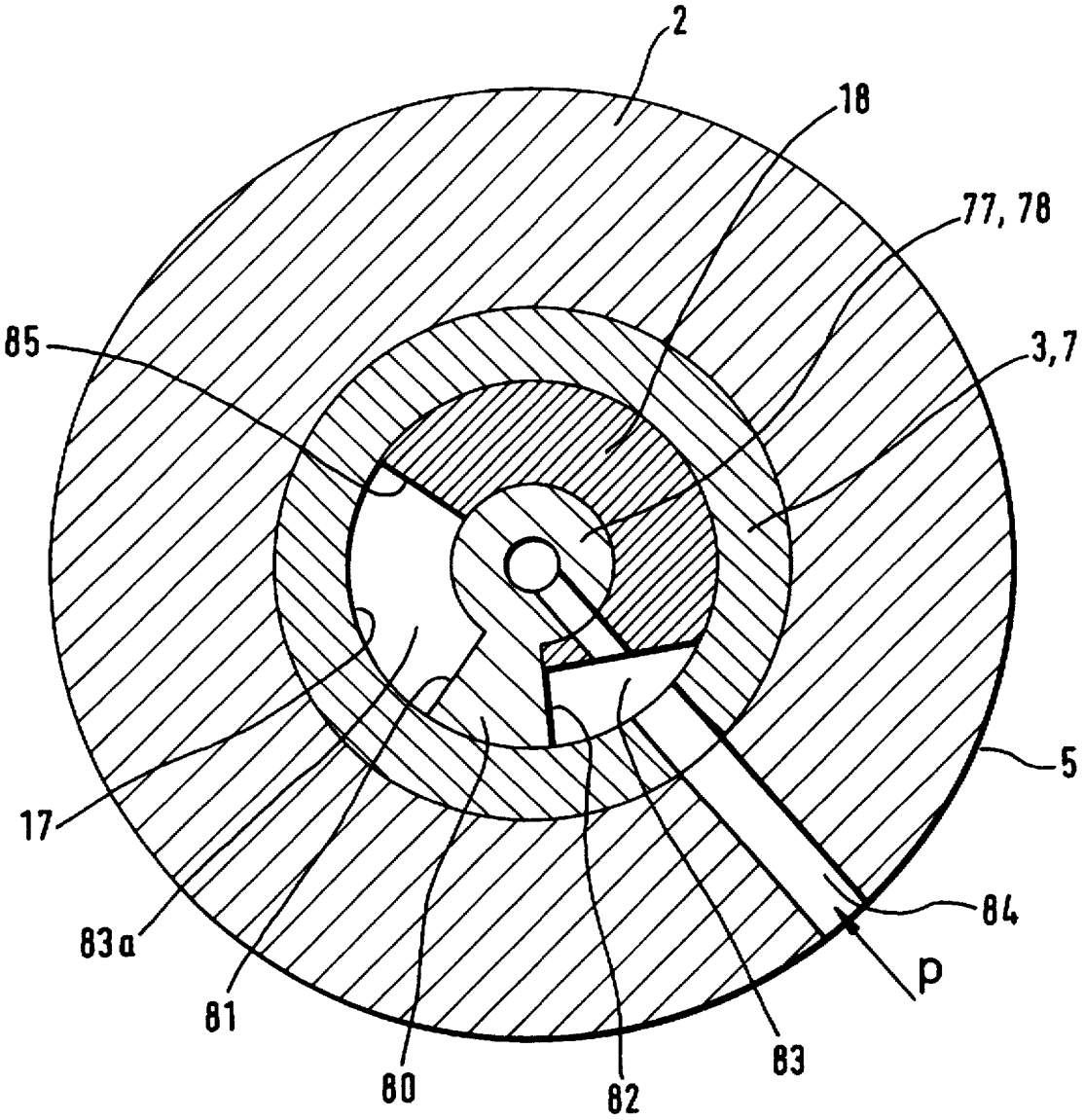

FIGS. 5 to 7 show still another embodiment of the switchable tappet 1 of the invention. A special feature of this embodiment is that the inner piston 18 is mounted for rotation about its axis in the bore 17 of the guide bush 7. The second piston 23 is retained radially inwards in a pressureless state in its bore 22 in the inner piston 18 by a tension spring 24. In this state of pressure, an intermediate disc 64 arranged in front of the second piston 23 overlaps the annular gap 25. An additional compression spring 73 acts radially inwards on the intermediate disc 64. This spring 73 extends in the radial bore 26 of the guide bush 7. In the base circle phase of the cams 71, 72, the radial bore 26 is aligned to the bore 22 for the second pistons 23.

As can be seen in FIG. 6, the axis of the first piston 10 extends at right angles to the axis of the second piston 23. Each tappet 1 comprises two first piston arrangements which are situated diametrically opposite each other. The first piston 10 is again arranged in its bore 13 in the annular bottom portion 2 and is urged radially inwards by the force of the compression spring 12. An intermediate element 76 corresponding in thickness to the guide bush 7 is arranged in front of the first piston 10 in a bore 75 of the guide bush 7. Due to the fact that the inner end surface 74 of first piston 10 does not intersect the separating surface 14, and the intermediate disc 64 overlaps the annular gap 25, a partial stroke of the tappet 1 as a whole in accordance with the central cam 72 is realized.

With increasing hydraulic pressure, the second piston 23, together with the intermediate disc 64 arranged in front of it, is displaced radially outwards so that its outer end surface 27 comes to be situated immediately in front of the annular gap 25 and the intermediate disc 64 is pushed into its bore 26 in the guide bush 7. This position corresponds to a zero lift of the tappet 1 as a whole.

To make it possible for the inner piston 18 to rotate, the inner piston 18 comprises a centrally arranged intermediate piston 77 (see also FIG. 7). This intermediate piston 77 extends in the bore 17 of the guide bush 7 and possesses an extension 78 pointing in cam direction and extending in a complementary recess 79 in the inner piston 18. A wing 80 starting from the extension 78 of the intermediate piston 77 extends radially outwards up to the bore 17 of the guide bush 7. A recess 83*a* permitting the desired amount of rotation of the inner piston 18 relative to the fixed wing 80 is provided between one side face 81 of the wing 80 and the inner piston 18 in peripheral direction.

An additional recess 83 extends in peripheral direction between a second side face 82 and the inner piston 18. Hydraulic medium can be routed into this recess 83 through a duct 84 extending through the annular bottom portion 2 and the guide bush 7. When hydraulic medium is transferred into this recess 83, the inner piston 18 rotates, in this case in anti-clockwise direction, and comes to bear with its stop surface 85 against the side face 81 of the wing 80. The stop surface 85 and the side face 81 enclose an angle of 90° so that the bore 22 for the second piston 23 aligns with the bore 13 for the first piston 13 (see FIG. 6). By a further supply of hydraulic medium, not specified here, to the second piston 23, it is possible to displace the second piston 23 together with the intermediate element 76 and the first piston 10 to a defined extent radially outwards against the force of the compression spring 12. The amount of displacement of the elements just mentioned is defined so that the second piston 23 overlaps the annular gap 25 and the intermediate element 76 intersects the separating surface 14. In this way, a maximum stroke of the tappet 1 as a whole is realized because a positive engagement is established between the elements 2, 3, 18.

With decreasing hydraulic pressure, a resetting of the inner piston 18 is effected by the force of a torsion spring 86 which extends in an annular space 87 between the intermediate piston 77 and the cam-distal end surface 19 of the inner piston 18 (see FIG. 5). The spring 86 surrounds a portion of the central extension 78 of the intermediate piston 77 while being fixed to the end surface 19 of the inner piston 18 and to the intermediate piston 77. The bushing 46 is again fitted into the bore 13 of the annular bottom portion 2 to bear directly against the bore 13. One end of the compression spring 12 is supported, in a manner known in itself, on the bottom 47 of the bushing 46. The bottom 47 of the bushing 46 comprises a passage 88 for air and excessive hydraulic medium. A prevention of relative rotation between the annular bottom portion 2 and the guide bush 7 is again effected by the inner end surface 53 of the bushing 46 which cooperates with a corresponding flattened portion 54 of the outer peripheral surface 34 of the guide bush 7.

A hydraulic clearance compensation element 90, not specified further, which cooperates directly with an end of a gas exchange valve is arranged in a camdistal bore 89 of the intermediate piston 77. In the previously described embodiments, it is conceivable to arrange such a clearance compensation element 90 in the bore 17 of the guide bush 7 or in the inner piston 18.

Figure 8:
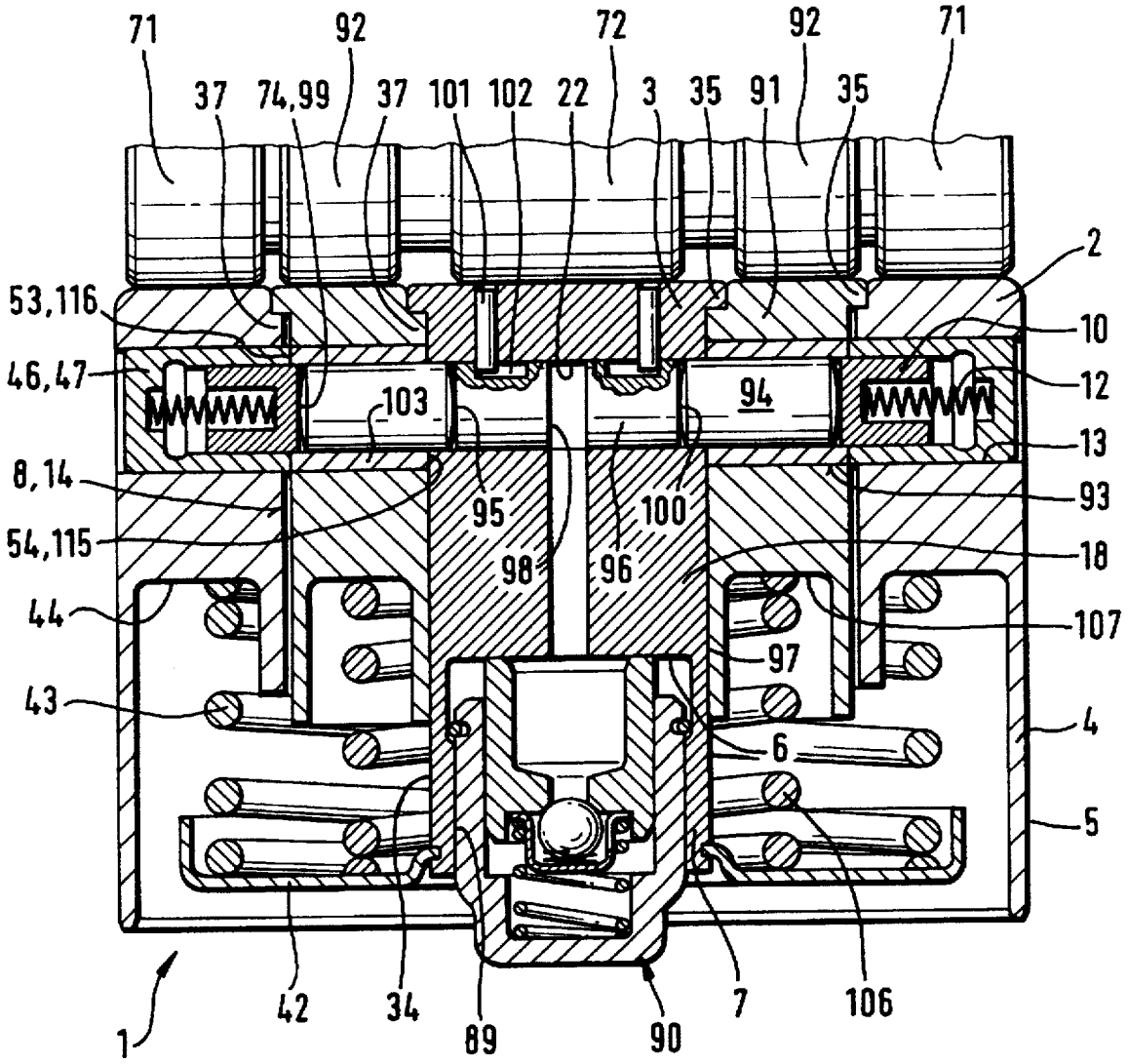
FIG. 8 is a longitudinal cross-section through a further embodiment.

Finally, another alternative embodiment of a switchable tappet 1 is shown in FIG. 8. In this embodiment, a further annular bottom portion 91 is arranged in the bore 8 of the annular bottom portion 2 radially between this and an outer peripheral surface 34 of the guide bush 7. The further annular bottom portion 91 is loaded by a cam 92 which transmits a lift dimensioned between the lifts of the cams 71 and 72 to the bottom portion 91. Analagous to the bottom portion 91, it is conceivable to arrange further similar bottom portions in the bore 8 to realize further different valve lifts. With such a configuration, the number of valve lifts possible corresponds to the number of cams of identical lift. A further radial bore 93 extending through the bottom portion 91 aligns with the radial bores 13, 22 of the bottom portions 2, 3 in the base circle phase of the cams 71, 92, 72. The first piston 10 is again arranged in the radial bore 13 of the outermost annular bottom portion 2 and is urged radially inwards by the compression spring 12. In this state of coupling, the inner end surface 74 of the first piston 10 intersects the separating surface 14. In the bore 93 of the additional annular bottom portion 91, there is arranged a sliding element 94. The length of this sliding element 94 is dimensioned so that, in this state of coupling, the sliding element 94 extends into the bore 22, and its inner end surface 95 contacts a push-out element 96 disposed in the bore 22.

In the coupling state represented in this figure, a maximum stroke of the tappet 1 is assured by the piston arrangement in accordance with the invention. To achieve further coupling steps, the entire piston arrangement can be displaced radially outwards against the force of the compression spring 12 by hydraulic pressure which can be applied to the inner end surfaces 98 of the push-out element 96. The hydraulic pressure can be increased to such an extent that the piston arrangement is displaced radially outwards till the inner end surface 74 of the first piston 10 no longer protrudes inwards beyond the radial bore 13. In this state, the sliding element 94 still intersects the inner separating surface 97 and its outer end surface 99 extends in front of the bore 8. The entire tappet now follows the lift contour of the control cam 92 because the bottom portions 91, 3 are positively engaged with one another through the sliding element 94.

If a state of coupling is desired in which the entire tappet 1 follows the lift curve of the central cam 72, which can be selectively made to achieve a minimum or a zero lift, the entire piston arrangement is displaced further outwards in radial direction by hydraulic pressure so that the inner end surface 95 of the sliding element 94 no longer extends radially inwards beyond its radial bore 93 and the outer end surface 100 of the push-out element 96 comes to be situated in front of the inner separating surface 97.

As viewed in axial direction, pins 101 extend from the circular bottom portion 3 into the bore 22 to engage into a complementary groove 102 of the push-out element 96. The length of this groove 102 is dimensioned so as to limit the axial displacement of the entire piston arrangement. A limitation of displacement of the pistons can also be achieved, for instance, by shoulders and the like, or by pins extending from the push-out element 96.

The circular bottom portion 3 and the further annular bottom portion 91 again comprise, at their cam-proximal ends, radially outwards projecting collars 35 which cooperate in the manner already described with steps 37 of the annular bottom portions 2, 91.

In this case too, a bushing 46 having a bottom 47 extends in the radial bore 13 of the annular bottom portion 2 for the direct reception of the first piston 10. The inner end surface 53 of the bushing 46 cooperates with a flattened portion 1/6 on the bottom portion 91. A further bushing 103 is arranged in the radial bore 93 of the bottom portion 91 for the direct reception of the sliding element 94.

In this embodiment too, there are likewise provided, in each tappet 1, two piston arrangements 10, 94, 96 situated diametrically opposite each other.

As can be seen in FIG. 8, as well as in FIGS. 1 and 5, a cam-distal end of the guide bush 7 is surrounded by a sheet metal ring 42. In the same manner as in FIGS. 1 and 5, a compression spring 43 is supported on this sheet metal ring 42, the other end of the compression spring 13 acting on the cam-distal end surface 44 of the annular bottom portion 2. In the embodiment of FIG. 8, an additional compression spring 106 is provided which acts on a cam-distal end surface 107 of the bottom portion 91. On the one hand, these compression springs 43, 106 establish an inner flow of forces within the tappet 1 and, on the other hand, they prevent, in conjunction with the elements 35, 37, a falling-apart of the tappet components during transportation.

Thus, in the embodiment of FIG. 8, the axially displaceable inner piston 18 is omitted. But this embodiment has the advantage that, theoretically, any number of different valve lifts can be realized by the choice of an appropriate number of intermediate pistons with associated cams. A person skilled in the art will, however, appreciate that the number of different lifts obtainable is limited by the increasing complexity of the structure and by the design space available per gas exchange valve.

We claim:

1. A tappet (1) for a valve drive of an internal combustion engine comprising an annular bottom portion (2) arranged concentrically around a circular bottom portion (3), the annular bottom portion (2) being contacted by at least one cam (71) of higher lift than a cam contacting the circular bottom portion (3), and said annular and circular bottom portions (2, 3) being slidable relative to each other, the tappet (1) being guided for longitudinal displacement in a bore (114) of a cylinder head (70) by a skirt (4) connected to the annular bottom portion (2), while a cam-distal end surface (6) of the circular bottom portion (3) received a guide bush (7) which is at least partly surrounded by a bore (8) of the annular bottom portion (2), at least one radially displaceable first piston (10) which serves as a coupling element for a selective positive coupling between the two bottom portions (2, 3) in a base circle phase of the cams (71, 72) being arranged in a region near the two bottom portions (2, 3), and said first piston (10) can be loaded in at least one direction of travel by a hydraulic medium and in an opposite direction of travel optionally by hydraulic medium or by the force of a spring (12), while, to establish a coupled state, said first piston (10) overlaps a separating surface (14) extending between said two bottom portions (2, 3) characterized in that an inner piston (18) is slidably arranged in a bore (17) of the guide bush (7) at a distance from the cam-distal end surface (6) of the circular bottom portion (3), an opposite end surface (19) of the inner piston (18) cooperating at least indirectly with an end of a valve stem, and the inner piston (18) comprises at least one radial bore (22) for lodging a second piston (23) which constitutes a coupling element which is displaceable in the base circle phase of the cams (71, 72) optionally by hydraulic medium or by the force of at least one spring (24).

2. A tappet of claim 1 wherein the bore (22) for the second piston (23) arranged in the inner piston (18) is made as a through-bore in whose ends the second pistons (23) are arranged diametrically opposite each other, the second pistons (23) can be displaced radially outwards by the force of at least one compression spring (24), so that, in the absence of effective hydraulic pressure, said second pistons (23) overlap the annular gap (25 or 25*a*) between the two elements (18, 7) and extend partly into a bore (26) of the guide bush (7), and the second pistons (23) can be pushed by hydraulic pressure, against spring force into their bore (22) in the inner piston (18) so that their outer end surfaces (27) do not project radially outwards beyond the opening (28) of the bore (22) (FIG. 1).

3. A tappet of claim 2 wherein a radial bore (13) starting from the separating surface (14) between the two bottom portions (2, 3) extends through the annular bottom portion (2) for partially receiving the first piston (10) to establish a coupled state, a stop disc (15) is arranged radially outwardly in the radial bore (13) to limit a displacement of the first piston (10), and a radially inner end surface (32) of the stop disc (15) cooperates with a flattened portion (33) of an outer peripheral surface (34) of the guide bush (7) to prevent rotation (FIG. 1).

4. A tappet of claim 2 wherein a radially protruding collar (35) is arranged on a cam-proximal end of the circular bottom portion (3), when the bottom portions (2, 3) are pushed together, said collar (35) cooperates with at least one member of the group consisting of a radially inwards pointing portion (36) of the inner end surface (32) of the stop disc (15) and with a bore-proximal step (37) of the cam-proximal end surface (38) of the annular bottom portion (2) (FIG. 1).

5. A tappet of claim 2 wherein the first pistons (10) are positioned in a radial bore (11) of the circular bottom portion (3) and retained by the force of at least one tension spring (12) in an uncoupling state in the absence of effective hydraulic pressure so as not to intersect the separating surface (14) between the two bottom portions (2, 3) (FIG. 1).

6. A tappet of claim 2 wherein the guide bush (7) is made in two parts comprising a guiding part, which is connected to the circular bottom portion (3) and a further bush (20) which is fixed in the guiding part and directly receives the inner piston (18) (FIG. 1).

7. A tappet of claim 6 wherein at least one substantially axially extending hydraulic medium channel (29) is arranged in at least one member of the group consisting of the outer peripheral surface (108) of the further bush (20) and in the bore (17) of the guiding part, said channel (29) starts from a transverse bore (30) made through the guide bush (7) and a collar (9) of the annular bottom portion (2) and opens in an annular space (31) in front of the outer end surface (27) of the second piston (23) (FIG. 1).

8. A tappet of claim 1 wherein the bore (22) for the second piston (23) in the inner piston (18) is made as a pocket bore, on whose base (45) the second piston (23) is supported by a compression spring (24), said second piston (23) in its idling position overlaps the annular gap (25) between the inner piston (18) and the guide bush (7) and extends partially, at least indirectly, in a radial bore (26) of the guide bush (7), a further radial bore (13) sealed radially outwardly in an oiltight manner by a bushing or a disc (46) is arranged in the annular bottom portion (2) and, in the base circle phase of the cams (71, 72), is aligned to the bore (22) for the second piston (23), the second piston (23) can be pushed inwards against the force of the compression spring (24) by hydraulic medium which can be transferred into a radial bore (58) of the annular bottom portion (2) up to a point directly in front of an outer end surface (48) of the second piston (23), so that the second piston (23) no longer protrudes radially outwards from its bore (22) in the inner piston (18) (FIG. 2).

9. A tappet of claim 8 wherein the first piston (10) is positioned at least indirectly in a radial bore (13) of the annular bottom portion (2) and retained by the force of at least one compression spring (12) in an uncoupling state so that an inner end surface (109) of the first piston (10) does not intersect the separating surface (14) between the two bottom portions (2, 3), the radial bore (13) is sealed radially outwardly in an oiltight manner by a bushing or a disc (46), and the first piston (10) can be displaced radially inwards against the force of the compression spring (12) by hydraulic medium which can be transferred into the radial bore (13) of the annular bottom portion (2) up to a point directly in front of an outer end surface (49) of the first piston (10) so that the first piston (10) intersects the separating surface (14) between the two bottom portions (2, 3) (FIG. 2).

10. A tappet of claim 8 wherein hydraulic medium is transferred into the radial bores (13, 58) to a point in front of the outer end surfaces (49, 48) of the first and the second pistons (10, 23) through at least one supply bore (51, 50) which, starting from an outer peripheral surface (5) of the skirt (4) extends through the annular bottom portion (2) in chord-like manner, at right angles to the radial bores (13, 58) (FIG. 2).

11. A tappet of claim 10 wherein separate supply bores (51, 50) are provided for the first and the second pistons (10, 23) (FIG. 2).

12. A tappet of claim 9 wherein in each radial bore (26) of the guide bush (7) for receiving the first and the second pistons (10, 23), there is fixed a ring (52) whose two end surfaces (53) cooperate with corresponding opposing flattened portions (54, 55) on the inner piston (18) and on the bushing (56, 46) of the annular bottom portion (2) (FIG. 2).

13. A tappet of claim 1 wherein the bore (22) for the second piston (23) is aligned to a radial bore (13) for the first piston (10) in the base circle phase of the cams (71, 72), the second piston (23) is urged radially outwards by the force of at least one inner compression spring (24) so that, in the absence of effective hydraulic pressure, the second piston (23) does not intersect the separating surface (14) between the annular bottom portion (2) and the guide bush (7) of the circular bottom portion (3) but overlaps the annular gap (25) between the guide bush (7) and the inner piston (18) to effect a coupled state, and a stepwise uncoupling of the annular bottom portion (2), the circular bottom portion (3) and the inner piston (18) can be effected by the first piston (10) which can be displaced radially inwards in a hollow cylindrical cavity (59) of the second piston (23) (FIG. 3).

14. A tappet of claim 13 wherein, in the absence of effective hydraulic pressure, the first piston (10) extends in its radial bore (13) in the annular bottom portion (2) while a part of the first piston (10) extends in the inner cavity (59) of the second piston (23), the first piston (10) being positioned relative to a bottom (60) of the second piston (23) by an outer compression spring (12), with increasing hydraulic pressure, the first piston (10) can be displaced against the force of its weaker outer compression spring (12) into the cavity (59) of the second piston (23) so that the outer end surface (49) of the first piston (10) does not intersect the separating surface (14), and, with further increasing hydraulic pressure, both pistons (10, 23) can be displaced together inwards so that their outer end surfaces (49, 27) do not overlap the annular gap (25) (FIG. 3).

15. A tappet of claim 13 wherein a disc or bushing (46) is arranged in the radial bore (13) of the annular bottom portion (2) to limit a radially outward displacement of the first piston (10) (FIG. 3).

16. A tappet of claim 13 wherein hydraulic medium is transferred into the radial bore (13) of the first piston (10) through at least one supply bore (51) which, starting from an outer peripheral surface (5) of the skirt (4), extends through the annular bottom portion (2) in chord-like manner, at right angles to the radial bore (13) (FIG. 3).

17. A tappet of claim 15 wherein the radial bore (13) is sealed in an oiltight manner at its outer end by a plug (61), an outlet of the chord-like bore (51) into the radial bore (13) is situated between the plug (61) and the disc (46) which limits the radial bore (13), and the disc (46) comprises at least one aperture (62) for a transfer of hydraulic medium to the outer end surface (49) of the first piston (10) (FIG. 3).

18. A tappet of claim 13 wherein a ring (52) for receiving the second piston (23) is fixed in a radial bore (26) of the guide bush (7), an end surface (53) of the ring (52) oriented towards the inner piston (18) cooperates with a corresponding flattened portion (54) of the inner piston (18), at least one securing element (63) extends, at a circumferentially offset point, through the annular bottom portion (2), and a radially inner flattened portion (54) of the securing element (63) cooperates with a corresponding flattened portion (55*a*) of the guide bush (7) (FIG. 3).

19. A tappet of claim 1 wherein the bore (22) for the second piston (23) extends generally at right angles to and in a common transverse plane with the bore (13) for the first piston (10), and, in the absence of effective hydraulic pressure, the first piston (10) can be displaced radially inwards by the force of at least one compression spring (12) so as to overlap the separating surface (14) between the annular bottom portion (2) and the circular bottom portion (3) (FIG. 4).

20. A tappet of claim 19 wherein an intermediate disc (64) is arranged in front of a radially inner end surface (109) of the first piston (10), a thickness of the intermediate disc (64) corresponds to a wall thickness of the guide bush (7), in a pressureless state of the tappet (1) an outer peripheral surface of the intermediate disc (64) overlaps the annular gap (25) between the guide bush (7) and the inner piston (18), a push-out element (65) which is displaceable in a bore direction and whose inner surface (110) is configured as a piston surface for loading by hydraulic medium is arranged in front of an inner end surface (109*a*) of the intermediate element (64), and, in the absence of effective hydraulic pressure, the second piston (23) is displaced radially inwards into its bore (22) by the force of at least one tension spring (24) so as not to overlap the annular gap (25), whereby the elements (2, 3, 18) are coupled to one another (FIG. 4).

21. A tappet of claim 19 wherein the force of the tension sprin (24) is greater than the force of the compression spring (12), with increasing hydraulic pressure, the elements (64, 10) arranged in front of the push-out element (65) are displaceable radially outwards so that the intermediate disc (64) extends within its bore (26) in the guide bush (7), and, with further increasing hydraulic pressure, the second piston (23) is displaceable against the force of its tension spring (24) radially outwards into its bore (22) so as to overlap the annular gap (25) and extend partly in a complementary recess (66) of the guide bush (7) (FIG. 4).

22. A tappet of claim 20 wherein the push-out element (65) or its bore (111) comprises a longitudinal groove (67) having a length corresponding to the desired displacement, said longitudinal groove (67) being engaged by a stop element (68) (FIG. 4).

23. A tappet of claim 19 wherein, in a radially outer end of the bore (13) for the first piston (10), there is fixed a bushing or disc (46) on whose base (45) the compression spring (12) for loading the first piston (10) is supported, said bushing or disc (46) comprising at least one deaeration aperture (112) (FIG. 4).

24. A tappet of claim 21 wherein, in the bore (26) of the guide bush (7), there is fixed a ring (52) whose two end surfaces (53) cooperate with corresponding flattened portions (54, 55) of the inner piston (18) and the bushing (46) (FIG. 4).

25. A tappet of claim 1 wherein the spring (24) for the second piston (23) arranged in its bore (22) in the inner piston (18) is configured as at least one tension spring, an intermediate disc (64) is arranged in front of the second piston (23) and urged radially inwards by a compression spring (73) which is fixed at one end in a radial bore (26) of the guide bush (7), in the absence of effective hydraulic pressure, said intermediate disc (64) overlaps the annular gap (25) between the inner piston (18) and the guide bush (7), in the base circle phase of the cams, said radial bore (26) of the guide bush (7) is aligned to the bore (22) for the second piston (23) in the inner piston (18), the first piston (10) is arranged circumferentially offset in its bore (13) in the annular bottom portion (2) and is displaceable radially inwards by the force of at least one compression spring (12), and, in the absence of effective hydraulic pressure, the inner end surface (74) of the first piston (10) does not intersect the separating surface (14) between the two elements (2, 7), so that a partial lift of the tappet (1) is realized (FIGS. 5, 6).

26. A tappet of claim 25 wherein, with increasing hydraulic pressure, the second piston (23) is displaceable against the force of its tension spring (24) so that its outer end surface (27) extends in front of the annular gap (25) between the elements (18, 7) and displaces the intermediate disc (64) into the radial bore (26) of the guide bush (7) (FIG. 5, 6).

27. A tappet of claim 25 wherein the inner piston (18) is designed to be rotatable relative to the guide bush (7) and rotates on a further increase of hydraulic pressure so that its bore (22) with the second piston (23) is aligned to the bore (13) for the first piston (10), the first piston (10) is displaced radially outwards in its bore (13) by the second piston (23) against the force of its compression spring (12), in a bore (75) of the guide bush (7) aligned to the bore (13) of the first piston (10) there is positioned an intermediate element (76) whose outer peripheral surface, in this state of coupling, overlaps the separating surface (14) between the elements (2, 7), while, at the same time, the second piston (23) overlaps the annular gap (25) between the elements (18, 7) (FIGS. 5 to 7).

28. A tappet of claim 25 wherein an intermediate piston (77) comprising a central extension (78) pointing in cam direction is arranged in the bore (17) of the guide bush (7) between the cam-distal end (19) of the inner piston (18) and the gas exchange valve, said extension (78) extends in a complementary recess (79) of the inner piston (18) and comprises a wing (80) extending radially up to the bore (17) of the guide bush (7), one side face (81) of the wing (80) cooperates with a recess (83*a*) in the inner piston (18) permitting the desired amount of rotation of the inner piston (18), the inner piston (18) comprises a further recess (83) arranged in circumferential direction between the inner piston (18) and a further side face (82) of the wing (8), which further recess (83) cooperates with a hydraulic medium duct (84) extending in radial direction through the annular bottom portion (2) and the guide bush (7) so that a rotation of the inner piston (18) relative to the stationary wing (80) is effected by feeding hydraulic medium into the further recess (83) (FIG. 7).

29. A tappet of claim 28 wherein a resetting of the inner piston (18) is effected by at least one torsion spring (86) acting against hydraulic pressure, said torsion spring (86) extends in an annular space (87) between the cam-distal end (19) of the inner piston (18) and the intermediate piston (77) and surrounds a portion of the central extension (78) of the intermediate piston (77) while being fixed at one end to the cam-distal end (19) of the inner piston (18) and at a second end, to the intermediate piston (77) (FIG. 5).

30. A tappet of claim 25 wherein a bushing or a disc (46) comprising at least one aperture (88) is fixed in a radially outer end of the bore (13) for the first piston (10) in the annular bottom portion (2) and constitutes an end stop for the compression spring (12) of the first piston (10), the stop is made as a bushing, the first piston (10) is lodged directly in a bore of the bushing and an inner end surface (53) of the bushing (46) cooperates with a corresponding flattened portion (54) of the guide bush (7) to prevent rotation of the annular bottom portion (2) relative to the guide bush (7) (FIG. 6).

31. A tappet according to the generic part of claim 1, characterized in that at least one further annular bottom portion (91) is arranged in the bore (8) of the annular bottom portion (2) radially between this bore (8) and an outer peripheral surface (34) of the guide bush (7), said further annular bottom portion (91) is contacted by at least one cam (92) having a smaller lift than the cam (71) acting on the annular bottom portion (2) arranged therearound, which further annular bottom portion (91) can be selectively coupled to at least one of the other bottom portions (2,3) by the radially displaceable first pistons (10) (FIG. 8).

32. A tappet of claim 31 wherein a radial bore (13, 93, 22) is arranged in each of the bottom portions (2, 91, 3), which radial bores (13, 93, 22) are aligned to each other in the base circle phase of the cams (71, 92, 72), the first piston (10) which is supported by at least one compression spring (12) extends in the radial bore (13) of the outermost annular bottom portion (2) while protruding inwardly out of this radial bore (13), a sliding element (94) is arranged radially inwardly in front of the first piston (10) and protrudes beyond an inner separating surface (97) of the further annular bottom portion (91) to extend in the radial bore (22) of the circular bottom portion (18) and bear radially inwardly against a push-out element (96) which can be loaded in outward direction on its inner end surface (98) (FIG. 8).

33. A tappet of claim 32 wherein the piston arrangement (96, 94, 10) can be displaced radially outwards by hydraulic pressure so that an inner end surface (74) of the first piston (10) does not protrude inwardly beyond the radial bore (13) of the first piston (10), and an outer end surface (99) of the sliding element (94) likewise does not protrude outwardly beyond the radial bore (93) of the sliding element (94) but extends inwardly in the radial bore (22) of the circular bottom portion (3), and, with a further increase of hydraulic pressure, the sliding element (94) is displaceable radially outwards so that its inner end surface (95) does not protrude inwardly beyond its radial bore (93) (FIG. 8).

34. A tappet of claim 32 wherein a limitation of a displacement of the push-out element (96) is effected by a pin-and-groove connection (101, 102), the pin (101) extending in axial direction optionally from the circular bottom portion (3) or from the push-out element (96), while the groove (102) is made in each case in the respective other element (96, 3) (FIG. 8).

35. A tappet of claim 31 wherein the circular bottom portion (3) and each further annular bottom portion (91, 2) surrounding it comprises a radially outwardly projecting collar (35) which is configured as an axial stop for a bore-proximal step (37) of the outer and the further annular bottom portion (2, 91) (FIG. 8).

36. A tappet of claim 31 wherein, in at least one of the radial bores (13, 93, 22) of the bottom portions (2, 91, 3), there is arranged a separate bushing (46, 103) in whose bore the respective coupling element (10, 94 or 96) extends, and an inner end surface (53, 115) of the bushing (46 or 103) cooperates with a corresponding flattened portion (116, 54) of the component (91, 3) arranged radially inwardly adjacent thereto (FIG. 8).

37. A tappet of claim 1 wherein a hydraulic clearance compensation element (90) is arranged at a cam-distal end of the tappet (18) in the bore (89) of the guide bush (7) (FIG. 5, 8).

38. A tappet of claim 1 wherein at least one deaeration bore (113) starting from the bore (17) of the guide bush (7) is arranged in the region of the circular bottom portion (3), said deaeration bore (113) being arranged preferably in an edge region between the guide bush (7) and the circular bottom portion (3) (FIG. 5).

39. A tappet of claim 2 wherein the inner piston (18) comprises at least one axially extending deaeration bore (39) between its cam-distal and cam-proximal ends (19, 41) (FIG. 1).

40. A tappet of claim 1 wherein the tappet (1) is configured for at least three coupling steps which are associated to appropriately chosen pressure levels, a hydraulic pressure for a first coupling step being approximately 0.7 bars, for a second coupling step, 0.7 to 2.5 bars and for a third coupling step, ≧2.5 bars.

41. A tappet of claim 1 wherein a prevention of rotation of the annular bottom portion (2) with its skirt (4) relative to the bore (114) in the cylinder head (70) is effected by at least one longitudinally extending cylindrical body (69) in the skirt (4), a portion of an outer peripheral surface of said body (69) extending in a complementary recess of the cylinder head (70) (FIG. 4).

42. A tappet of claim 1 wherein the inner piston (18) is supported on the cam-distal end surface (6) of the circular bottom portion (3) by a compression spring (40), and the distance between a cam-proximal end surface (41) of the inner piston (18) and the cam-distal end surface (6) of the circular bottom portion (3) corresponds at least to a height of a zero lift displacement of the inner piston (18) relative the guide bush (7) (FIG. 1, 5).

43. A tappet of claim 1 wherein a cam-distal end of the guide bush (7) is surrounded by a sheet metal ring (42) on which is supported one end of at least one compression spring (43, 106) whose other end acts at least indirectly on a cam-distal end (44, 107) of the respective annular bottom portion (2, 91).

44. A tappet of claim 1 wherein at least one of the components (2, 3, 10, 18, 42, 46, 52, 63, 64, 76, 77, 91, 103) is made of a plastic and/or light-weight material.

* * * * *